US008965029B2

(12) United States Patent
Mizuno et al.

(10) Patent No.: US 8,965,029 B2
(45) Date of Patent: Feb. 24, 2015

(54) HEADPHONE

(71) Applicant: Sony Corporation, Tokyo (JP)

(72) Inventors: Kenzi Mizuno, Kanagawa (JP); Tomohiro Ito, Tokyo (JP); Yuusuke Oosato, Kanagawa-Ken (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/743,134

(22) Filed: Jan. 16, 2013

(65) Prior Publication Data

US 2013/0195307 A1 Aug. 1, 2013

(30) Foreign Application Priority Data

Jan. 31, 2012 (JP) ..... 2012-018276

(51) Int. Cl.
*H04R 25/00* (2006.01)
*H04R 1/10* (2006.01)

(52) U.S. Cl.
CPC ..... *H04R 1/1091* (2013.01); *H04R 1/1075* (2013.01); *H04R 1/1008* (2013.01); *H04R 1/105* (2013.01)
USPC ..... 381/371; 381/386; 381/378

(58) Field of Classification Search
CPC .... H04R 1/1008; H04R 1/105; H04R 1/1075; H04R 1/1091
USPC ..... 381/386, 370, 184, 186, 374, 345, 371, 381/378, 182; D14/216, 215
See application file for complete search history.

(56) References Cited

U.S. PATENT DOCUMENTS

| | | | | |
|---|---|---|---|---|
| 3,751,608 | A * | 8/1973 | Weingartner | 381/372 |
| D610,572 | S * | 2/2010 | Skurdal | D14/216 |
| 7,680,267 | B2 * | 3/2010 | Bradford et al. | 379/430 |
| 8,085,966 | B2 * | 12/2011 | Amsel | 381/370 |
| 8,094,860 | B2 * | 1/2012 | Huang | 381/386 |
| 8,284,972 | B2 * | 10/2012 | Lin | 381/322 |
| 8,422,714 | B2 * | 4/2013 | Peng | 381/345 |
| 8,503,710 | B1 * | 8/2013 | Meyberg et al. | 381/370 |
| D691,587 | S * | 10/2013 | Ferber et al. | D14/216 |
| D692,411 | S * | 10/2013 | Joseph | D14/215 |
| D692,413 | S * | 10/2013 | Holzer | D14/216 |
| D694,218 | S * | 11/2013 | Szymanski | D14/216 |
| 8,582,755 | B2 * | 11/2013 | Bradford et al. | 379/430 |
| 2008/0170738 | A1 * | 7/2008 | Hope et al. | 381/371 |
| 2010/0128916 | A1 * | 5/2010 | Bradford et al. | 381/386 |

FOREIGN PATENT DOCUMENTS

JP 2004-032645 1/2004

* cited by examiner

*Primary Examiner* — Davetta W Goins
*Assistant Examiner* — Phylesha Dabney
(74) *Attorney, Agent, or Firm* — Rader, Fishman & Grauer PLLC

(57) ABSTRACT

A headphone includes a housing having a storage space in the interior thereof and a driver unit provided within the storage space movably with respect to the housing.

6 Claims, 6 Drawing Sheets

HEADPHONE

BACKGROUND

The present disclosure relates to a headphone. More specifically, it relates to a headphone having a mechanism that improves bass range reproducibility and wearability by stabilizing the positions of sound sources when the headphone is worn.

There have been developed a variety of headphones in the past having headbands and adapted to entirely cover the ears of the wearers.

Examples of such headphones include headphones having driver units, which are the sound sources, that are fixedly disposed substantially in parallel to the sides of the head of the wearer and headphones having driver units fixed in slightly angled relationship with respect to the sides of the head of the wearer.

Japanese Patent No. 3950750 discloses a headphone including a back shell in which a sound output part is housed, an ear holder which is mounted on auricles, and a separator for covering the sound emission surface of the sound output part. According to Japanese Patent No. 3950750, this headphone can be used over a long time period without causing pain and/or discomfort due to close contact and/or pressure to the auricle (see Japanese Patent No. 3950750, claim 1, paragraph 0052, FIGS. 1 to 3, and FIG. 7).

There has been a demand for a headphone with further improved bass range reproducibility and wearing comfort, compared with the headphones in the past.

SUMMARY

When using a headphone with fixed driver units in the past, some users feel that sounds are weak and bass sounds are limited because, when the headphone is worn, the driver units are positioned apart from the auricles depending on the fixed positions and angles of the driver units and the shapes of the auricles of the users. Especially with an open-type headphone, when the driver units are positioned apart from the auricles, the reproducibility of bass sounds tends to be limited. Additionally, when the headphone is worn, the driver units touch the auricles and cause pain to some users.

Long-time use of the headphone disclosed by Japanese Patent No. 3950750 could cause pain to some users in touch regions because, similarly to an ear-hooked earphone, the touch force is centered on the top and back of the head behind the auricles, although it depends on the material of the headphone.

It is desirable to provide a headphone having a mechanism that can stabilize the positions of the sound sources for a variety of wearers, thereby ensuring high bass range reproducibility and also reducing pain to the auricles when the headphone is worn.

The headphone according to an embodiment of the present disclosure includes housings each having a storage space in the interior thereof and a driver unit disposed within the storage space movably with respect to the housing.

According to the embodiment of the present disclosure, because the driver unit is movable, the headphone can uniformly position the sound source with respect to a variety of wearers with auricles different in shape, thereby ensuring high bass range reproducibility without causing pain to the auricles even if the driver units touch the auricles when the headphone is worn.

BRIEF DESCRIPTION OF THE DRAWINGS

FIGS. 5A to 5D show variations of elastic members in the headphone according to the embodiment of the present disclosure, in which FIG. 5A is a schematic view showing an embodiment of the elastic member, FIG. 5B is a schematic view showing another embodiment of the elastic member, FIG. 5C is a schematic view showing another embodiment of the elastic member, and FIG. 5D is a schematic view showing a further embodiment of the elastic member.

DETAILED DESCRIPTION OF EMBODIMENTS (Basic Structure of Headphone)

Figure 1:
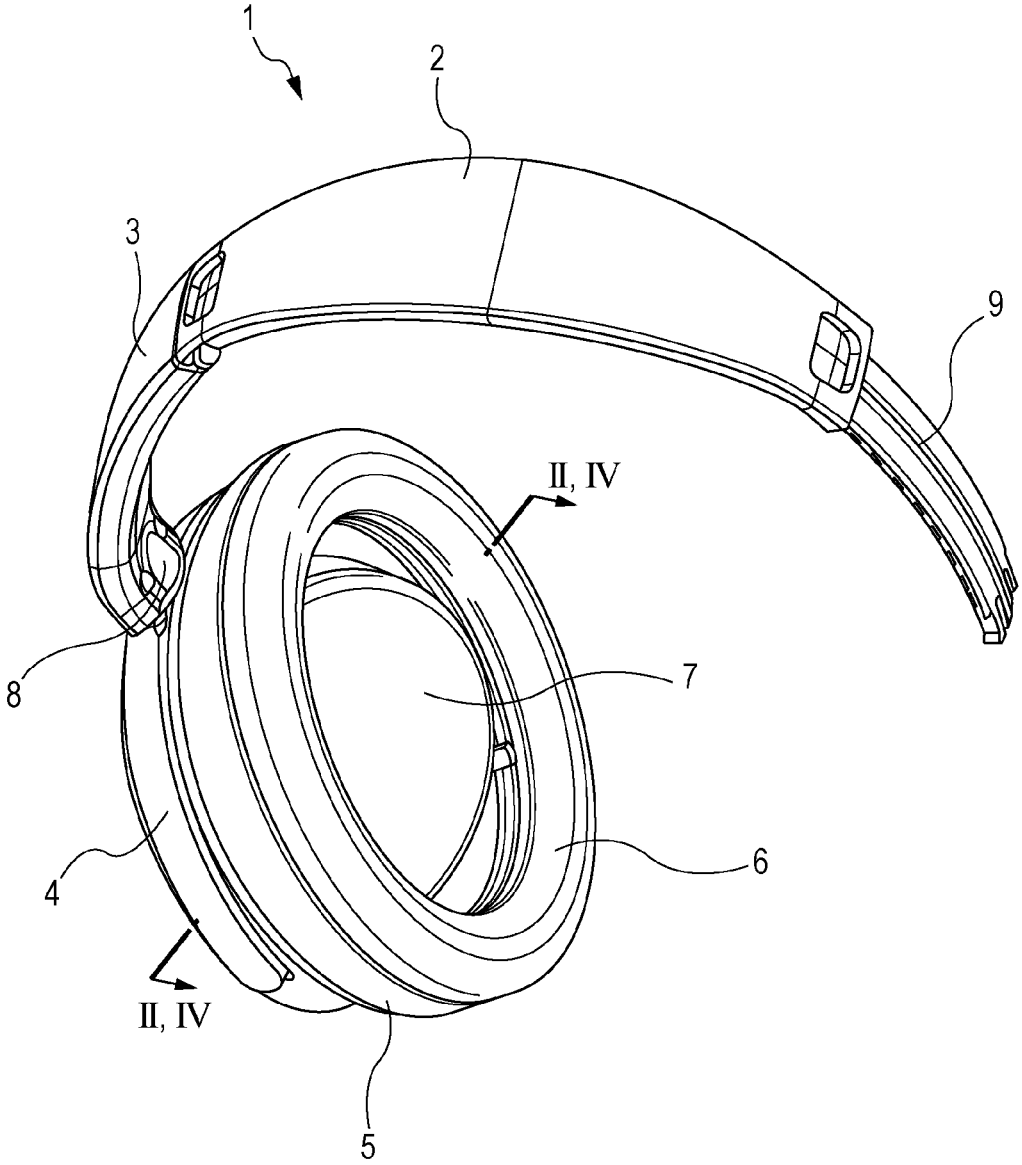
FIG. 1 is a perspective view showing a headphone according to an embodiment of the present disclosure.

Referring first to FIG. 1, the structure of a headphone 1 will be described. FIG. 1 shows an external appearance of the headphone 1 according to an embodiment of the present disclosure. Some members of the headphone 1 are omitted in FIG. 1 for convenience of description. The housing 5 and ear pad 6 on the left (L) channel side are structured similarly to those on the right (R) channel side.

The headphone 1 includes a headband 2, sliders 3, hangers 4, housings 5, ear pads 6, and driver unit assemblies 7 provided in the housings 5.

The headband 2 has a curved shape such that it extends along the head of the wearer and touches the top of the head of the wearer to support the entire headphone 1 being worn. The headband 2 is made of plastic or other synthetic resin, metal, or the like and has a predetermined rigidity and elasticity to provide flexibility. Accordingly, when the headphone 1 is worn, the headband 2 can retain the headphone 1 in place by pressing the housings 5 and ear pads 6 toward the sides of the head of the wearer. A portion of the inner surface of the headband 2 that touches the top of the head of the wearer may be provided with a buffer element made of rubber or other material. The headband 2 may also be provided with a hinge at the center thereof such that the headphone 1 can be folded when carried.

The sliders 3 are provided at both ends of the headband 2. A hanger 4 is attached to a joint 8 at one end of each slider 3. The sliders 3 are secured to both ends of the headband 2 and can slide along guide members 9 having an axis aligned with the central axis of the headband 2. The hangers 4 can be moved away from or toward the headband 2 by sliding the sliders 3 along the guide members 9. When the headphone 1 is worn, the housings 5 and ear pads 6 can be positioned against the ears of the wearer by adjusting the positions of the sliders 3 to the size of the head of the wearer and the distances between the ears and the top of the head. The wearer can therefore obtain a feeling of wearing adapted to his/her physical features, preference, and so on. When the headphone 1 is not used, the sliders 3 can be retracted to save the storage space.

The hanger 4 is attached to the tip of each slider 3 via the joint 8 to rotatably support the housing 5. It will be appreciated that the joint 8 may fixedly support the hanger 4, or may support the hanger 4 such that it can rotate about the axis of the headband 2 and guide member 9. The hanger 4 rotatably supports the housing 5 by pivotally supporting the housing 5 by support pins (not shown) inwardly protruding from a pair of tips of the hanger 4, for example. When the headphone 1 is worn, the housings 5 are oriented in accordance with the shapes of the ears and sides of the head of the wearer, so the housings 5 can face the ears of the wearer in a manner suited to the shapes of the sides of the head of the wearer.

The housing 5 contains a storage space that serves as a storage unit for housing, for example, a driver unit assembly 7 as the sound output unit for converting an electrical signal to a sound wave and outputs the converted sound wave. The housing 5 is formed from plastic or other synthetic resin, for example. The surface of the housing 5 opposite to the ear pad 6 is equipped with a plurality of sound release holes (not shown) that release the sound from the back side of the driver unit assembly 7 through the housing 5. The sound release holes, however, may not necessarily be provided. When the headphone 1 is structured as the so-called open-type headphone, the housing 5 is provided with sound release holes. On the other hand, when the headphone 1 is structured as the so-called closed-type headphone, it is not necessary to provide sound release holes. The positions of the housings 5 are fixed once the headphone 1 is worn.

Each ear pad 6 is disposed on the surface of the housing 5 facing the side of the head of the wearer. The ear pad 6 is located between the housing 5 and the side of the head of the wearer and functions as a buffer member between the housing 5 and the side of the head of the wearer. More specifically, when the headphone 1 is worn, the ear pad 6 prevents the housing 5 made of a rigid material difficult to deform from touching directly the ear and side of the head of the wearer and causing discomfort and/or pain to the wearer.

Although it depends on the material thereof, the ear pad 6 can also restrict sound release and serve to improve bass range reproducibility or other sound quality. The ear pad 6 also serves to prevent the sound output from the driver unit assembly 7 from leaking outward. The ear pad 6 also blocks external noise and thereby allows the sound from the driver unit assembly 7 to be heard easily. It is noted that the driver unit assembly 7 is movable with respect to the housing 5 before and after the headphone 1 is worn. The structure for enabling the driver unit assembly 7 to move will be described later with reference to FIGS. 2 to 4.

The headphone 1 may also be provided with a cable for carrying an electrical signal appropriately converted from sound. In the cable, a left channel conductor L, a right channel conductor R, a ground wire G, and so on are inserted to transmit the sound signal from a sound reproducing device (not shown), such as a portable music player or television receiver, to the headphone 1. One end of the cable is connected to the driver unit assembly 7 accommodated in one of the pair of housings 5. The other end of the cable is provided with a plug (not shown). When the plug is connected to a sound reproducing device, the headphone 1 is connected to this sound reproducing device.

To drive the driver unit assembly 7 in the other housing 5 to which the cable is not connected, an interconnection cable (not shown) is provided between the housing 5 to which the cable is connected and the other housing 5 to which the cable is not connected. One end of this interconnection cable is connected to the cable or the driver unit assembly 7 in the housing 5 to which the cable is connected and the other end of the interconnection cable is connected to the driver unit assembly 7 in the other housing 5 through the hanger 4, guide member 9, and headband 2. This interconnection cable transmits sound signals to the driver unit assembly 7 in the other housing 5 to which the cable is not connected. Alternatively, two cables may be connected to the left and right housings 5, respectively, such that sound signals are supplied to the driver unit assemblies 7 in both the right and left housings 5.

(Internal Structure of Housing)

Figure 2:
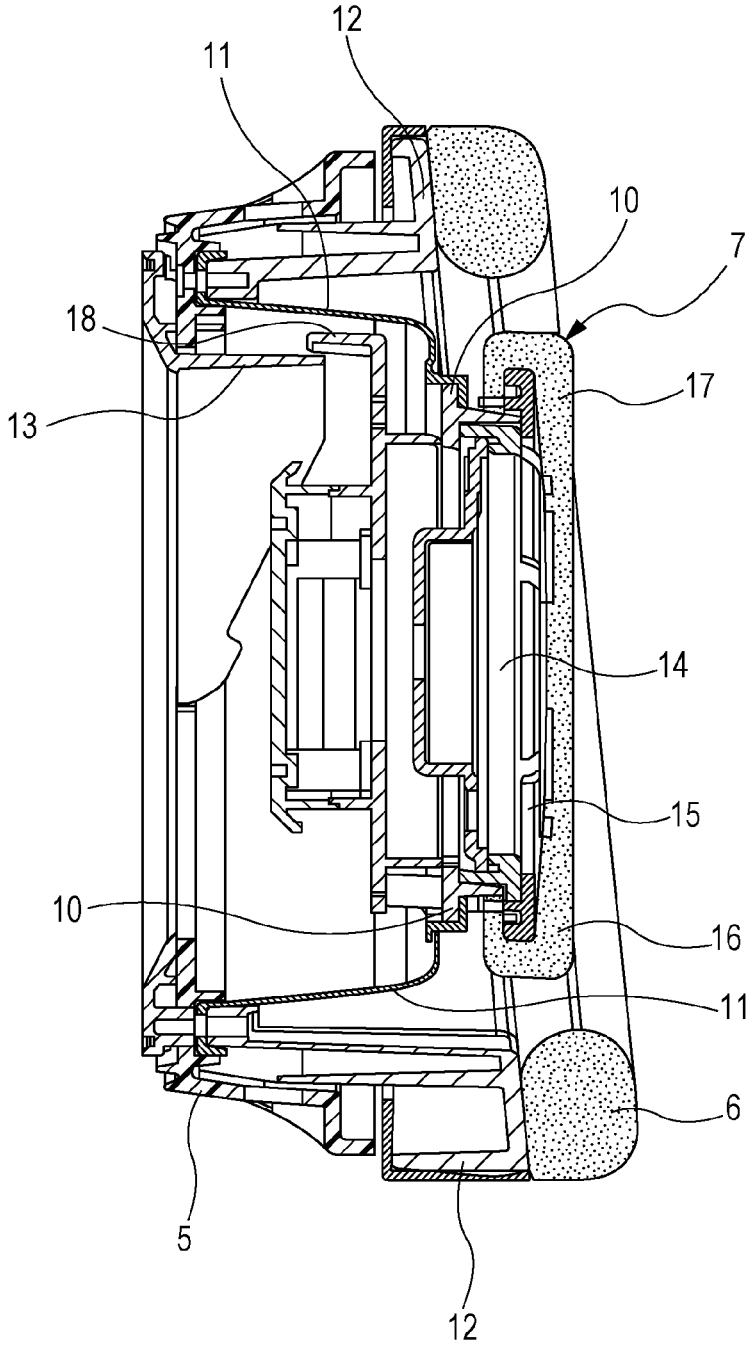
FIG. 2 is a sectional view along the line II-II in FIG. 1.
Figure 3:
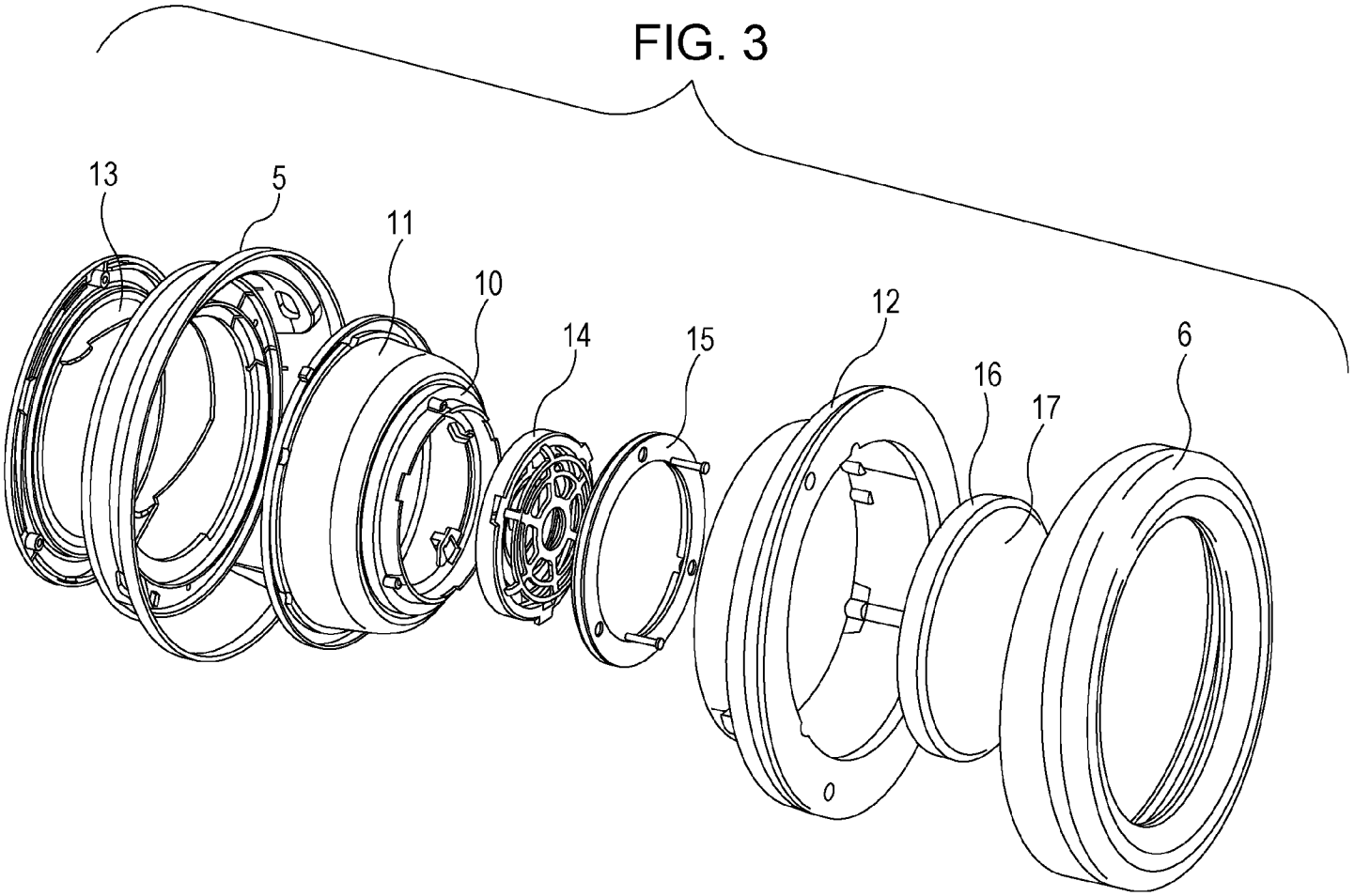
FIG. 3 is an exploded perspective view of the members shown in FIG. 2.

Referring now to FIGS. 2 and 3, the internal structure of the headphone housing according to the embodiment of the present disclosure will be described. FIG. 2 is a sectional view of the housing 5, ear pad 6, and driver unit assembly 7 in the headphone 1 along the line II-II in FIG. 1. FIG. 3 is an exploded perspective view of the housing 5, ear pad 6, and driver unit assembly 7.

As shown in FIG. 2, the housing 5 and driver unit assembly 7 are connected to each other via a unit holder 10 and membrane-like elastic body 11. The housing 5 and ear pad 6 are connected to each other via a front board 12. The membrane-like elastic body 11 is an example of the elastic member in the headphone according to the embodiment of the present disclosure.

As shown in FIG. 3, the housing 5 is substantially cylindrical with openings at both ends. The housing 5 accommodates therein the driver unit assembly 7, unit holder 10, and membrane-like elastic body 11. A stopper 13 is externally inserted into the housing 5 through the opening at one end. The stopper 13 will be described later along with the movement of the driver unit assembly 7 in the headphone being worn.

The driver unit assembly 7 includes a driver unit 14, unit cover 15, and auricle pad 16. The driver unit 14 is a member having a diaphragm and a protective cover for protecting the surface of the diaphragm and converts the signal received through the cable (not shown) to the sound to be played. The sound heard by the user of the headphone according to the embodiment of the present disclosure is output from the driver unit 14. The unit cover 15, which is a protective member for the driver unit 14, may be omitted from the headphone according to the embodiment of the present disclosure. The auricle pad 16 is a member for covering the driver unit 14 and unit cover 15. Since the unit cover 15 and auricle pad 16 are attached to the driver unit 14 so as to cover the driver unit 14, the unit cover 15 and auricle pad 16 are preferably made of material(s) and structures that do not block or shield the sound output from the driver unit 14. Since the auricle pad 16 is a member that directly touches the auricle of the wearer, a contact face 17, which is the surface of the auricle pad 16, preferably functions at least as a buffer member. The auricle pad 16 may be formed from a material similar to the ear pad 6, for example, or urethane or other appropriate expandable resin.

The ear pad 6 is annular in shape and is attached to the front board 12 in an appropriate manner. As shown in FIG. 3, the front board 12 is substantially cylindrical and has openings at both ends. An outwardly protruding rib is formed around one of the openings of the front board 12 such that the ear pad 6 is attached to the rib.

As shown in FIG. 3, the unit holder 10 and membrane-like elastic body 11 are integrally formed. The unit holder 10 is a member that is secured to the driver unit assembly 7 by adhesion, welding, fitting, screwing, or the like and is preferably more rigid than the membrane-like elastic body 11 described later. The membrane-like elastic body 11 is substantially cylindrical and is formed from a flexible soft material. The opening at one end of the membrane-like elastic body 11 and the unit holder 10 are integrally joined, while the opening at the other end of the membrane-like elastic body 11 is pressed and fixed by the front board 12. After pressing the opening of the other end of the membrane-like elastic body 11, the front board 12 may be adhered thereto with adhesive or the like. The unit holder 10 and membrane-like elastic body 11 may be formed by integrally joining different materials to each other by two-color molding or the like. It will be appreciated that, in the headphone according to the embodiment of the present disclosure, instead of being integrally formed by two-color molding or the like, the unit holder 10 and membrane-like elastic body 11 may be secured to each other by adhesion, welding, or the like.

The unit holder 10 may be made of any material capable of fixedly supporting the driver unit assembly 7, including, but not limited to, polyethylene (PE), polyethylene terephthalate (PET), polyvinyl chloride (PVC), polyvinylidene chloride (PVDC), polypropylene (PP), polyamide (PA), polycarbonate (PC), polystyrene (PS), polyester, ABS resin, AS resin, and acrylic resin, for example.

The material of the membrane-like elastic body 11 is not limited to any particular material, as long as it can exert an urging force for returning the driver unit assembly 7 to its original position even if the membrane-like elastic body 11 secured to the driver unit assembly 7 is deformed due to the movement of the driver unit assembly 7 and the properties of the material do not change under the temperature and humidity conditions in which the headphone is usually used. Examples of the material include elastomer and silicone rubber. The urging force of the membrane-like elastic body 11 should be as low as not to press too much against the auricle, not to cause pain to the wearer even if the membrane-like elastic body 11 touches the auricle over a long time period, or smaller than the lateral pressure of the headband of the headphone.

The driver unit assembly 7 is disposed closer to the auricle of the wearer than that in headphones in the past, so that the driver unit assembly 7 projects toward the auricle and side of the head of the wearer.

The unit holder 10 has a restricting member 18 that partially extends toward the housing 5, i.e., toward the back side of the headphone. The restricting member 18 will be described later along with the movement of the driver unit assembly 7 and the stopper 13.

(State of Headphone Being Worn)

Figure 4:
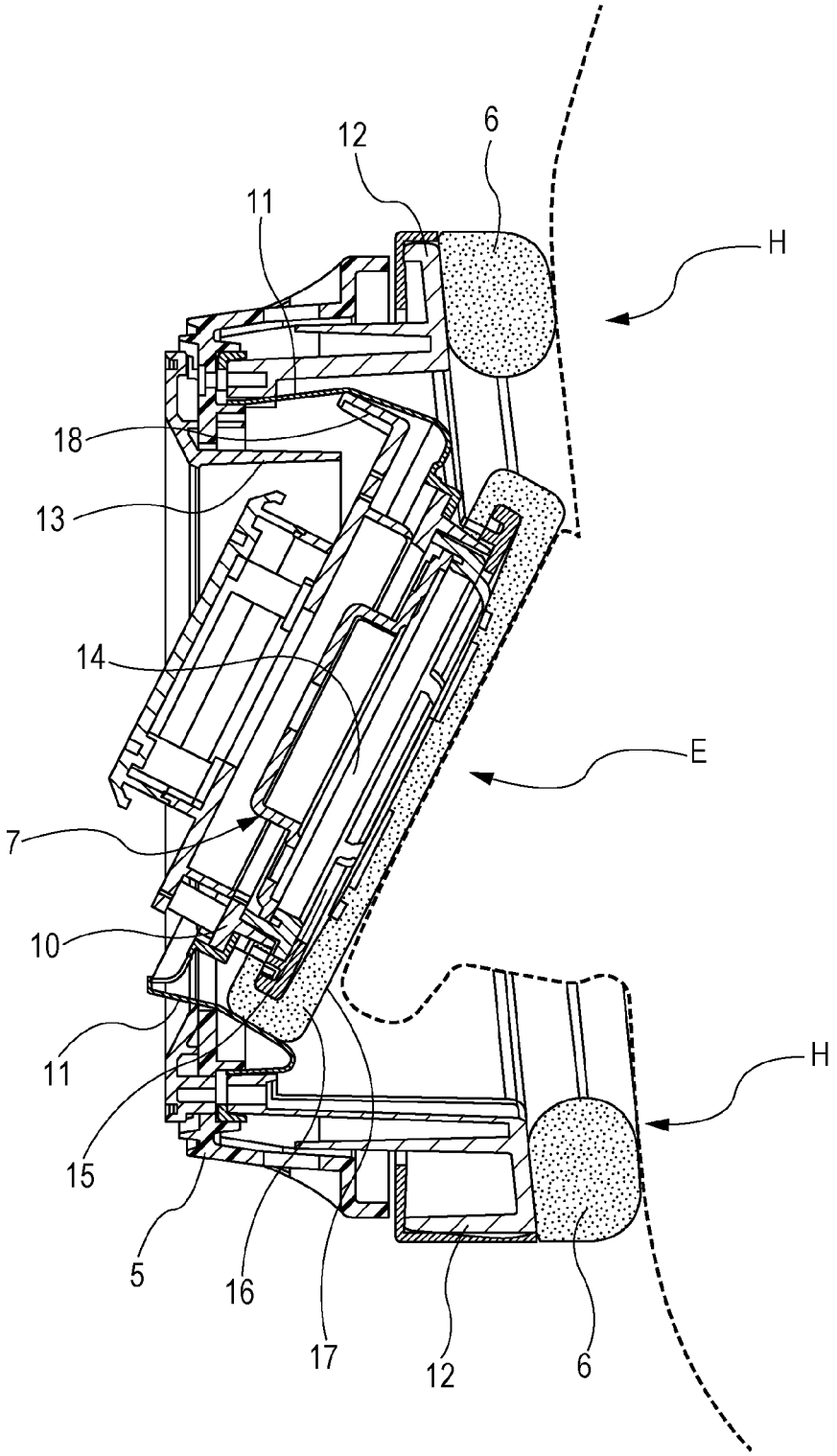
FIG. 4 is a sectional view along the line IV-IV of the headphone shown in FIG. 1 when being worn.

FIG. 4 is a sectional view of the headphone 1 worn by a wearer along the line IV-IV in FIG. 1. The bold dotted line in FIG. 4 represents the contour of the head and ear of the wearer viewed from the top of head.

In headphones in the past, the driver unit is fixed deep into the housing, i.e., toward the back side of the housing, such that the driver unit does not touch the auricle of the wearer. Since the volume of the housing is limited acoustically as well as in terms of design, the driver unit would occasionally touch the auricles of some wearers depending on the shapes of the auricles of the wearers. When the fixed driver unit in the headphone in the past touches the auricle of the wearer, the urging force of the headphone toward the side of the head would be exerted directly on the auricle of the wearer. Consequently, the headphone in the past, if worn over a long time period, would cause pain to the wearer.

Since the auricles differ in shape and size among wearers, the distance from the auricle to the driver unit differs among wearers when the driver unit is fixed. When the distance from the auricle to the driver unit differs, the sound to be heard differs among wearers and therefore a consistent sound quality may not be maintained. In particular, when the driver unit is positioned apart from the auricle of the wearer, the wearer would feel that the sounds are weak, the bass range is limited, and the sound pressure sensitivity is low. With an open-type headphone, the difference in sound pressure sensitivity due to the difference in distance between the driver unit and the auricle tends to become significantly noticeable.

In contrast, when the headphone 1 is worn, the side of the head H of the wearer touches the ear pad 6 and the auricle E of the wearer touches the contact face 17 of the driver unit assembly 7, as shown in FIG. 4. This is because the driver unit assembly 7 projects toward the auricle E and the side of the head H of the wearer, compared with the headphone in the past, as described above. Since the driver unit assembly 7 is movable with respect to the associated housing 5, the driver unit assembly 7 is positively brought into touch with the auricle E of the wearer and moved following the shape of the auricle. Unlike the headphone equipped with the fixed driver unit in the past, the headphone according to the embodiment of the present disclosure does not press against the auricles of the wearer even if the headphone is worn over a long time period. That is, the headphone according to the embodiment of the present disclosure does not cause pain to the auricles being touched.

Furthermore, once the headphone 1 is worn, the driver unit assemblies 7 are positioned following the shapes of the auricles E of the wearer and kept in touch with the auricles E, so the distances from the auricles E of the wearer to the driver unit assemblies 7 become identical among all the wearers. Accordingly, all the wearers hear the same sound, so a consistent sound quality can be maintained.

When the wearer removes the headphone 1 from the head thereof, the pressures from the auricles E to the driver unit assemblies 7 disappear and the urging forces of the membrane-like elastic bodies 11 return the driver unit assemblies 7 to the positions at which the driver unit assemblies 7 are located before the headphone 1 is worn.

The stopper 13 is a curved plate to be inserted into the housing 5 through the opening on the back side thereof. The restricting member 18, which extends from the unit holder 10 toward the back side of the housing 5, is adjusted to a size capable of interfering with the stopper 13 when the driver unit assembly 7 moves excessively toward the back side of the housing 5. Generally, headphones are often completed acoustically as well as in terms of design by providing an appropriate plate member on the rearmost side of the housing. Although not shown in FIGS. 1 to 4, if the plate member is provided in the rearmost side of the housing 5, the driver unit assembly 7 could possibly interfere with the plate member when the driver unit assembly 7 is excessively pressed toward the back side of the housing 5. From the viewpoint of long-term use and maintenance of the headphone 1, it is preferable that, when the driver unit assembly 7 is excessively pressed toward the back side of the housing 5, the restricting member 18 interferes with the stopper 13 to prevent further pressure. In this way, the stopper 13 and restricting member 18 can further improve the quality of the headphone, although these members may be omitted as long as the embodiment of the present disclosure can be achieved without them.

(Variations of Elastic Member)

FIGS. 5A to 5D and 6 show variations of the elastic member in the headphone according to the embodiment of the present disclosure. In FIGS. 5A to 5D, each elastic member is shown with the portion fixed to the housing down and with the unit holder 10 fixedly secured to the elastic member up.

Figure 5A:
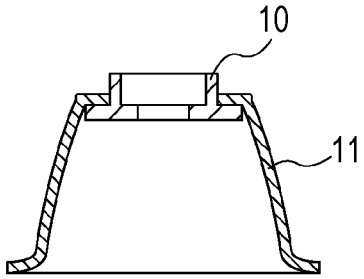
Figure 5B:
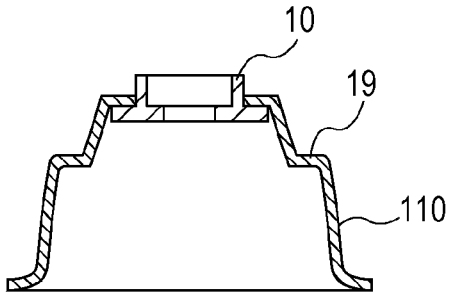
Figure 5C:
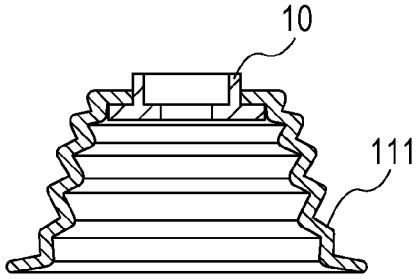
Figure 5D:
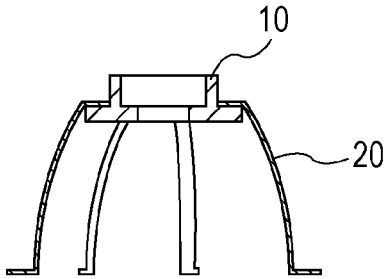

FIGS. 5A to 5C show elastic member variations formed from flexible membrane-like bodies. The membrane-like elastic body 11 shown in FIG. 5A is identical to the membrane-like elastic body 11 shown in FIGS. 2 to 4 and is denoted with the same reference numeral. The membrane-like elastic body 110 shown in FIG. 5B has a shoulder 19 extending from the portion secured to the housing to the portion secured to the unit holder 10. When the shoulder 19 is provided, the vicinity of the shoulder 19 deforms first when the membrane-like elastic body 110 deforms due to the movement of the driver unit assembly 7. If a thick shoulder 19 is formed, for example, the strength of the shoulder is improved and the membrane-like elastic body 110 can withstand repeated deformations without being irreversibly deformed or ruptured, thereby ensuring high reliability of the headphone. The membrane-like elastic body 111 shown in FIG. 5C has a circumferential side wall formed like bellows. Since the membrane-like elastic body 111 has an urging force owing to its bellows-like shape, the membrane-like elastic body 111 can be made of a material having a lower elasticity than the above membrane-like elastic bodies 11 and 110. The elastic member shown in FIG. 5D has a plurality of leaf springs 20. Each leaf spring 20 is an urging member made of an elongated laminar body and attached so as to be curved from one end thereof secured to the housing via the front board or the like to the other end secured to the unit holder 10. When the elongated leaf springs 20 are used, the leaf springs 20 are preferably arranged at regular intervals along the periphery of the unit holder 10 such that the driver unit can tilt in various directions.

Figure 6:
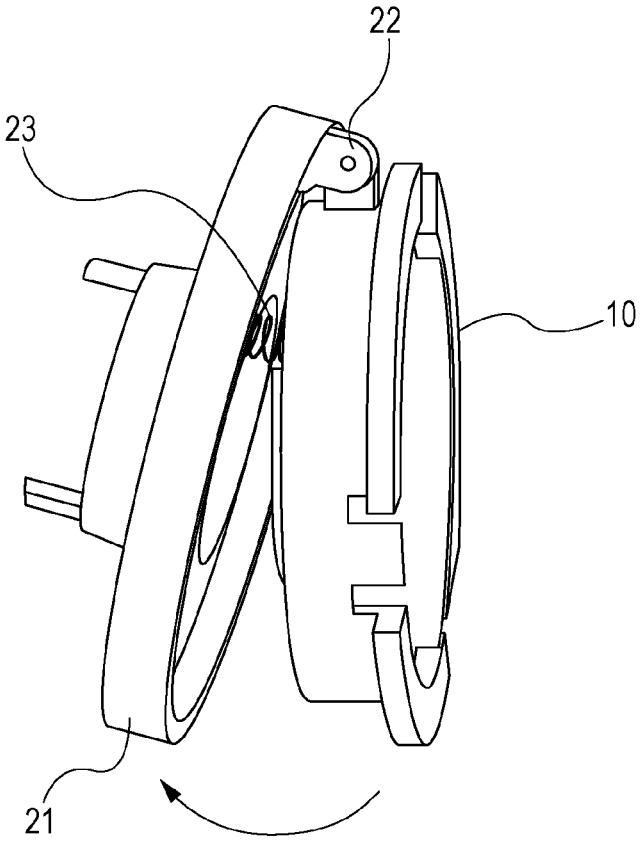
FIG. 6 is a perspective view showing a variation of the elastic member in the headphone according to the embodiment of the present disclosure.

FIG. 6 shows an example of elastic member that is formed as a spring-loaded hinge. As shown in FIG. 6, the unit holder 10 is connected to a receiving plate 21 via a pivot shaft 22. The receiving plate 21 is secured to the housing at an appropriate position thereof. A coiled spring 23, which is an urging member, is attached between the unit holder 10 and the receiving plate 21. When the headphone is not worn, the unit holder 10 is urged away from the receiving plate 21 by the urging force of the coiled spring 23. Once the headphone is worn, the driver unit pressed by the auricle moves, together with the unit holder 10, about the pivot shaft 22 toward the receiving plate 21 against the urging force of the coiled spring 23.

In the headphone according to the embodiment of the present disclosure, in which the driver unit is movable with respect to the housing, it is preferable that the driver unit is also tiltable in the direction in which the driver unit is most pressed by the external ear of the wearer. If the driver unit can tilt in the direction in which the driver unit is most pressed by the external ear of the wearer, the driver unit can follow the shape of the auricle of the wearer wearing the headphone according to the embodiment of the present disclosure and hardly causes the wearer to feel that the auricle is being pressed by the driver unit. Accordingly, the headphone according to the embodiment of the present disclosure can be worn by the wearer without feeling pressure and with improved wearing comfort, compared with headphones in the past.

When the elastic member is made of a membrane-like body, especially a non-porous membrane-like body, the membrane-like body completely separates the inner space of the housing between the portion near the auricle of the wearer and the portion extending from the driver unit to the back side of the housing. Since the sound emitted from the driver unit toward the back side of the housing and being routed toward the auricle of the wearer is blocked by the elastic member, the wearer can hear only the sound emitted from the driver unit toward the auricle. The elastic member also blocks external noise and the like, in addition to the sound being routed toward the auricle of the wearer. The elastic member made of a membrane-like body, therefore, acts as a vibration insulator and damper against unwanted sounds. A membrane-like body having a bellows-shaped circumferential side wall acts more effectively as a vibration insulator and damper, because vibrations transmitted to the membrane-like body is easily attenuated. Accordingly, the headphone according to the embodiment of the present disclosure further improves sound quality when the membrane-like body is used as the elastic member.

When it is found that the driver unit tilts substantially in one direction, it is adequate to adopt an embodiment using a hinge as the elastic member. Since the embodiment using a hinge as the elastic member is easier to fabricate than the embodiment using the above membrane-like body, it is possible to simplify the manufacturing process of the headphone.

While the embodiments of the present disclosure have been specifically described above, embodiments of the present disclosure is not limited to the above embodiments, but various variations are possible on the basis of the technical concept of the present disclosure.

For example, the configurations, methods, processes, shapes, materials, values, and the like included in the embodiments described above are only examples and different configurations, methods, processes, shapes, materials, values, and the like may be used as occasion calls.

Furthermore, the configurations, methods, processes, shapes, materials, values, and the like included in the embodiments described above may be combined with each other without departing from the scope and spirit of the present disclosure.

The embodiment of the present disclosure can also adopt the following configurations:

(1) A headphone including a housing having a storage space in the interior thereof, and a driver unit provided within the storage space movably with respect to the housing.

(2) The headphone according to item (1), wherein the driver unit is tiltable in the direction in which the driver unit is most pressed against the external ear of the wearer.

(3) The headphone according to item (1) or (2), wherein a connecting member for connecting a fixed body to the driver unit is an elastic member.

(4) The headphone according to item (3), wherein the elastic member is a spring-loaded hinge.

(5) The headphone according to item (3), wherein the elastic member is a flexible membrane-like body.

The present disclosure contains subject matter related to that disclosed in Japanese Priority Patent Application JP 2012-018276 filed in the Japan Patent Office on Jan. 31, 2012, the entire contents of which are hereby incorporated by reference.

What is claimed is:

1. A headphone adapted for wearing about a head of a user having an auricle projecting away from the user's head and having an outwardly projecting auricle surface area, the headphone comprising:

a housing in a form of a tubular structure having a first opening, a second opening disposed opposite the first opening and a storage space in the interior thereof and disposed between the first and second openings;

a driver unit provided within the storage space movably with respect to the housing;

wherein, when the user dons the headphone, at least a portion of the driver unit contacts at least a section of the outwardly projecting auricle surface area of the user's auricle and, immediately thereafter, the entirety of the driver unit tilts and the at least portion of the driver unit in contact with the user's auricle moves, with resistance, inwardly into the storage space as the headphone moves over and around the auricle to subsequently contact the user's head and surround the auricle; and wherein the driver unit moves into the storage space of the housing in a resiliently biased manner from an extended state to a retracted state, the driver unit being in the extended state prior to the user donning the headphone, being in the retracted state when the driver unit is moved into the storage space of the housing and the headphone contacts the user's head and surrounds the auricle and being resiliently biased towards the extended state.

2. The headphone according to claim 1, wherein the driver unit is tiltable in a direction in which the driver unit is most pressed against the auricle of the user.

3. The headphone according to claim 1, wherein a connecting member for connecting a fixed body to the driver unit is an elastic member.

4. The headphone according to claim 3, wherein the elastic member is a spring-loaded hinge.

5. The headphone according to claim 3, wherein the elastic member is a flexible membrane-like body.

6. The headphone according to claim 1, wherein, in the extended state, at least a piece of the driver unit extends outwardly from the storage space through the first opening and, in the retracted state, the driver unit is disposed entirely in the storage space between the first and second openings.

* * * * *